US006694931B2

(12) United States Patent
Palmer

(10) Patent No.: US 6,694,931 B2
(45) Date of Patent: Feb. 24, 2004

(54) INTERNAL COMBUSTION ENGINE

(76) Inventor: Dennis C. Palmer, 105 N. Irena, #1, Redondo Beach, CA (US) 92007

( * ) Notice: Subject to any disclaimer, the term of this patent is extended or adjusted under 35 U.S.C. 154(b) by 0 days.

(21) Appl. No.: 10/290,855

(22) Filed: Nov. 8, 2002

(65) Prior Publication Data

US 2003/0062005 A1 Apr. 3, 2003

Related U.S. Application Data

(62) Division of application No. 09/678,627, filed on Oct. 3, 2000, now Pat. No. 6,526,927.

(51) Int. Cl.[7] ..... F02B 75/18
(52) U.S. Cl. ..... 123/56.2
(58) Field of Search ..... 123/56.1–56.9

(56) References Cited

U.S. PATENT DOCUMENTS 4,492,188 A * 1/1985 Palmer et al. ..... 123/56.8
5,007,385 A * 4/1991 Kitaguchi ..... 123/48 B
5,553,582 A * 9/1996 Speas ..... 123/56.4

* cited by examiner

*Primary Examiner*—Noah P. Kamen
(74) *Attorney, Agent, or Firm*—Dennis W. Beech

(57) ABSTRACT

The improved internal combustion engine of the cam drive axial piston type includes modification to the drive shaft, bearings and other internal elements to facilitate the flow of oil and lubricants to engine parts. The cooling system is modified to allow coolant flow directly to the engine block and head assembly simultaneously and to control flow through the engine and radiator to reduce hot spots. The valves and valve crown structure have been modified for ease of assembly and reliability of the roller valve lifter and valve interface. Use of alternate fuel supply systems which eliminate the need for a valve train are also accommodated. The drive shaft and engine have been modified to allow the mounting of a variety of aircraft propellers using a hub as well as mounting a flywheel for reduced start motor stress.

2 Claims, 6 Drawing Sheets

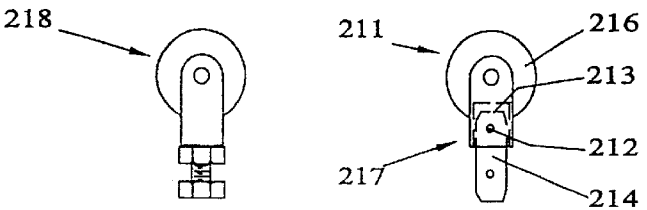
FIG.10
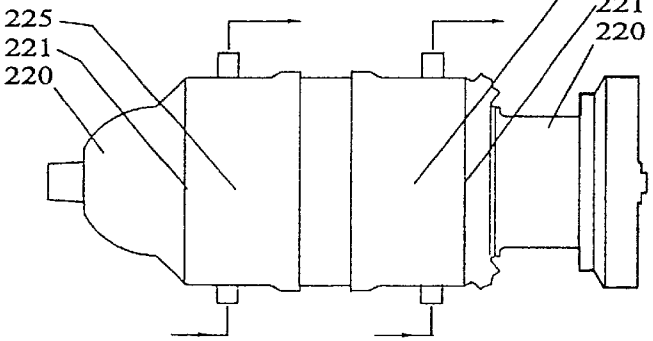
PRIOR ART
FIG.9
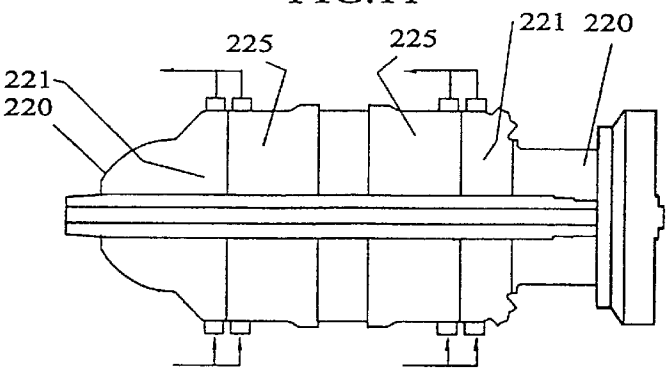
FIG.11
FIG.12
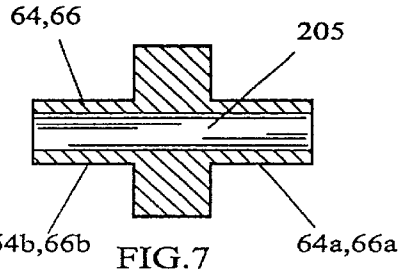
FIG.7
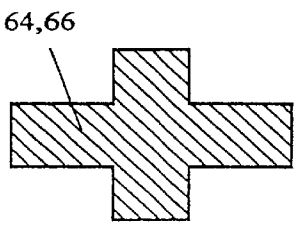
FIG.6
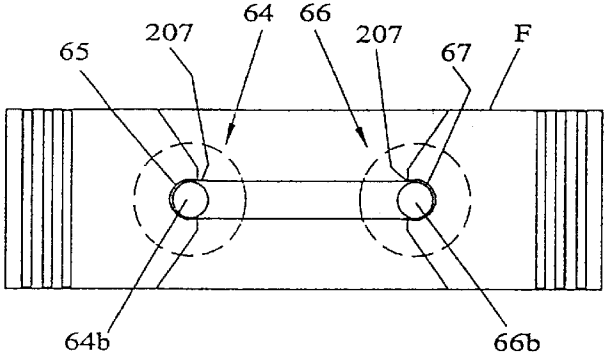
FIG.7A
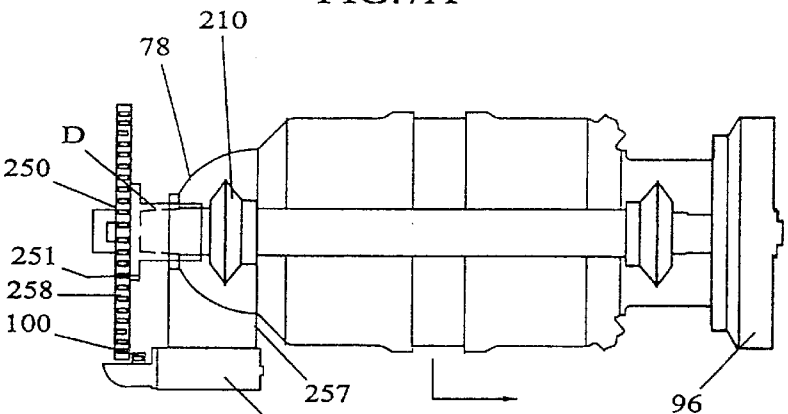
FIG.8

INTERNAL COMBUSTION ENGINE

CROSS-REFERENCE TO RELATED APPLICATIONS

This is a divisional application of U.S. patent application Ser. No. 09/678,627 filed Oct. 3, 2000. Application Ser. No. 09/678,627 is now U.S. Pat. No. 6,526,927.

BACKGROUND OF THE INVENTION

1. Field of the Invention

This invention relates to internal combustion engines of the cam drive axial piston type. The improved engine includes lubrication, valve, cooling, fuel supply and external equipment mounting elements.

2. Description of Related Art

There are currently disclosed in the literature a variety of configurations of internal combustion engines of the cam drive axial piston type. Example include those disclosed in U.S. Pat. Nos. 4,492,188 and 5,749,337, issued Jan. 8, 1985 and May 12, 1998 respectively.

The cam drive axial piston type engine offers advantages as described in the U.S. Pat. No. 4,492,188; however, a cost effective structure for such an engine is necessary. The original disclosure included such structure as a single head assembly and engine block, a drive shaft limiting the means of assembly of the engine and the variety of aircraft propellers that could be accommodated, as well as other non-optimizing features. The present invention improves the engine structure for ease of manufacture and assembly, improved lubrication and cooling, increased valve train reliability, use of alternate fuel supply systems, and other engine structural changes such as accommodating a variety of aircraft propeller mountings.

The U.S. Pat. No. 5,749,337 discloses an engine structure which is designed for use without a traditional valve train. It does use dual head pistons which require a different diameter at each piston end. Also the scavenging requires routing of gas from one end of the engine to the other. The instant engine simplifies and improves the structure for elimination of the valve train and scavenging by using adjacent cylinders for firing and compression. In addition the dual engine pistons are a constant diameter thereby reducing stress of the piston. The new invention also accommodates use of a supercharger/turbocharger for air supply and scavenging.

SUMMARY OF THE INVENTION

One object of the present invention is improved oil/lubricant flow and application to parts of an internal combustion engine of a cam drive axial piston type. Another object is cooling system changes for improved temperature control. A further object is modification of the valves and valve crown assembly for more reliable valve operation, assembly and maintenance. A still further object is accommodation of alternate fuel supply and exhaust systems. Yet another object is drive shaft and fly wheel modifications for ease of mounting a variety of aircraft propellers and ease of engine start up.

In accordance with the description presented herein, other objectives of this invention will become apparent when the description and drawings are reviewed.

BRIEF DESCRIPTION OF THE DRAWING

FIG. 6 illustrates a longitudinal cross sectional view of a cam follower.

FIG. 7 illustrates a longitudinal cross sectional view of a cam follower having a hollow center portion.

FIG. 7A illustrates a side view of a piston with two cam followers mounted therein.

FIG. 8 illustrates a side elevation schematic view of the preferred embodiment engine with detachable valve crown assembly.

FIG. 9 illustrates an elevation view of a mechanical roller valve lifter.

FIG. 10 illustrates an elevation view of a hydraulic roller valve lifter.

FIG. 11 illustrates a side elevation view of an engine single port cooling system.

FIG. 12 illustrates a side elevation view of an engine dual port cooling system.

DESCRIPTION OF THE PREFERRED EMBODIMENT

The internal combustion engine (A) of the present invention is of the barrel type having two identical elongated engine blocks (B), that are axially aligned but oppositely disposed, and joined by a generally cylindrical tubular spacer (C). Each block (B) includes a first end portion (10)

and a second end portion (12) adjacent the spacer (C). While to engine blocks (B) are described in the preferred embodiment, with appropriate modification the elements of the invention may be applied to an engine (A) with only a single block (B).

Internal combustion engines of the cam drive axial piston or barrel type are disclosed in various patents as earlier discussed. For this embodiment the engine improvements presented will be made with reference to the engine (A) as contained in U.S. Pat. No. 4,492,188 which by reference is hereby incorporated. While the engine described in the reference patent is used for purposes of describing the instant invention., it can be understood that the improvements disclosed may be used with other internal combustion engines having the structure to incorporate such improvements.

For an engine (A), the cost to manufacture, the performance of the engine, the interface with user equipment, and the reliability may all be improved by incorporating elements of the instant invention. The engine includes improved oil/lubricant flow and application to engine parts; cooling system changes for temperature control; modification to valves and valve crown assembly; alternate fuel and exhaust system configuration; and other engine structural changes including the mounting assembly for aircraft propellers.

Figure 1:
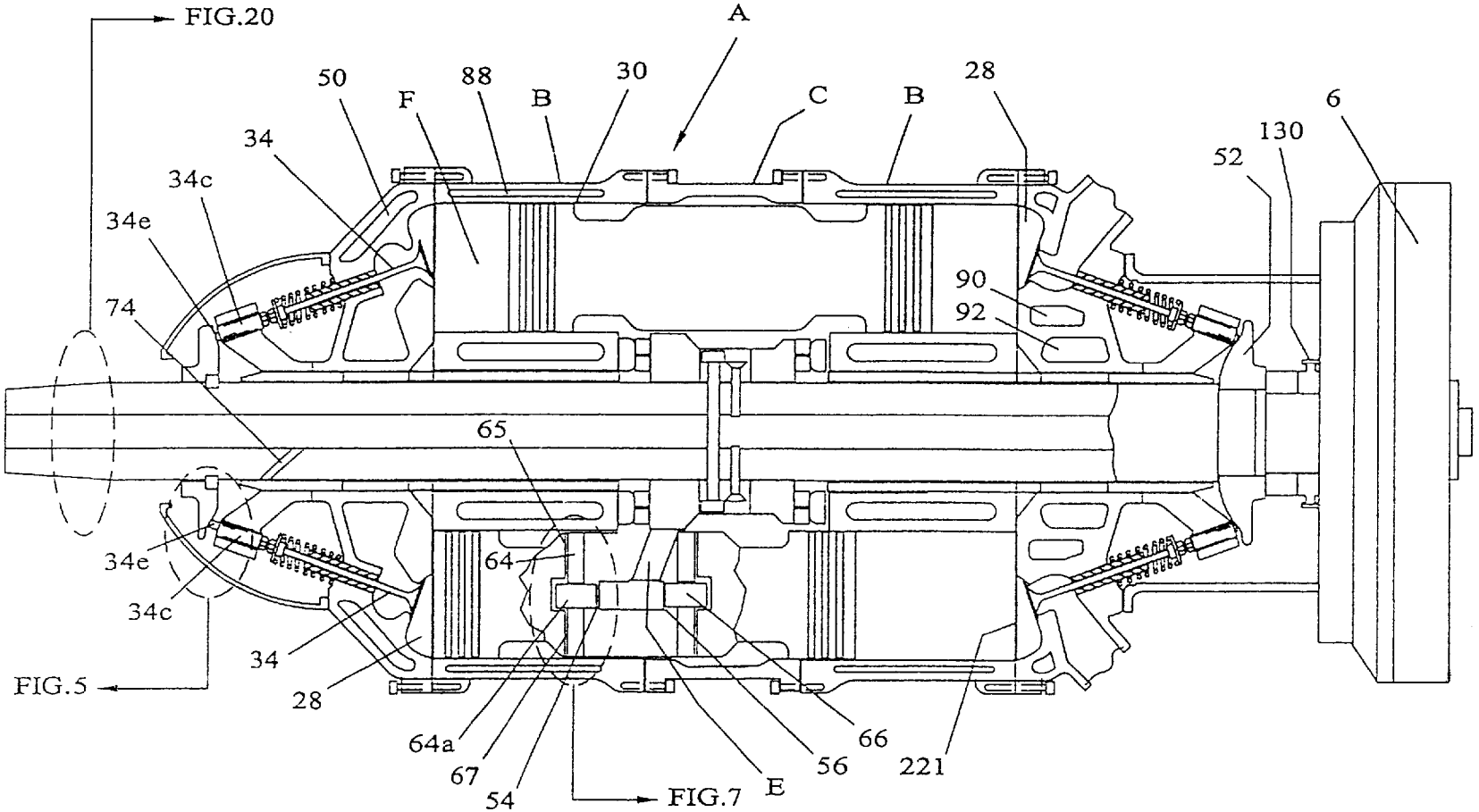
FIG. 1 illustrates a side elevation longitudinal cross sectional view of a cam drive axial piston internal combustion engine.
Figure 3:
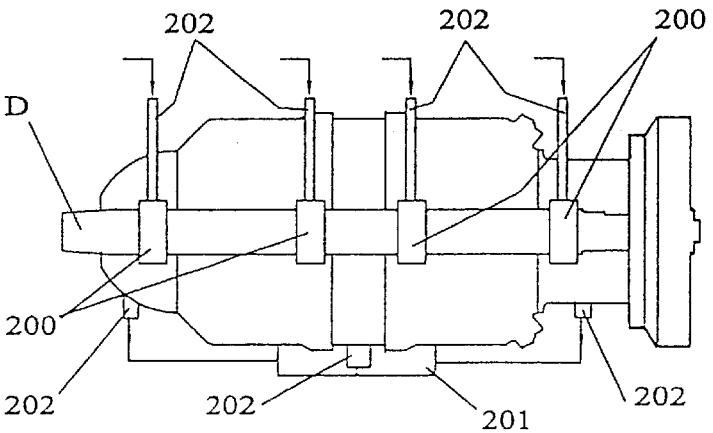
FIG. 3 illustrates a side elevation view of the preferred embodiment lubrication system.
Figure 2:
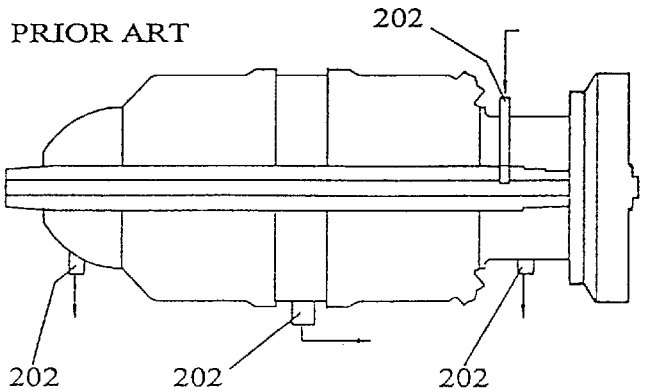
FIG. 2 illustrates a side elevation view of a prior art engine lubrication system.

Referring to FIGS. 1 through 3, the prior method for lubricating the engine (A) was to use a hollow drive shaft (D) to introduce oil flow which would then flow outward therefrom through holes or transverse passages (74) and then through other access openings to lubricate the elements of the engine. In this configuration when the engine is not running, the oil may become less viscous and thickened. This can create sludge conditions which inhibit oil flow until an engine has reached higher temperature as for example during a start and warm up cycle. Such conditions may damage parts due to inadequate lubricating oil flow.

In the present invention the lubricant is introduced through oil apertures (202) directly to the drive shaft main bearings (200). This allows oil to reach the main bearing (200) without first passage through a hollow drive shaft and subsequent passage such as transverse passage (74). The oil then flows from the main bearings (200) into the remainder of the engine for lubrication before flowing to an oil sump (201) which may be either gravitity flow or pumped by a scavenging device. This structure allows oil to flow quickly to the main bearings (200) during engine start up without delay from flowing through a hollow drive shaft which may be restricted by accumulation of deposited non-viscous oil residue.

Figure 5:
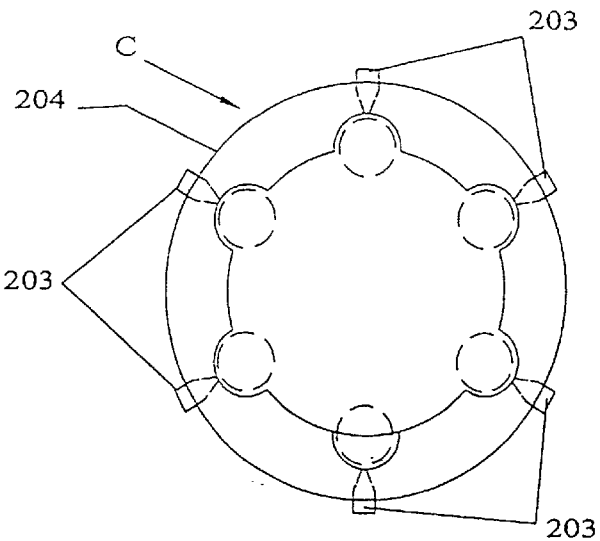
FIG. 5 illustrates an end view of the tubular spacer with lubrication ports.
Figure 4:
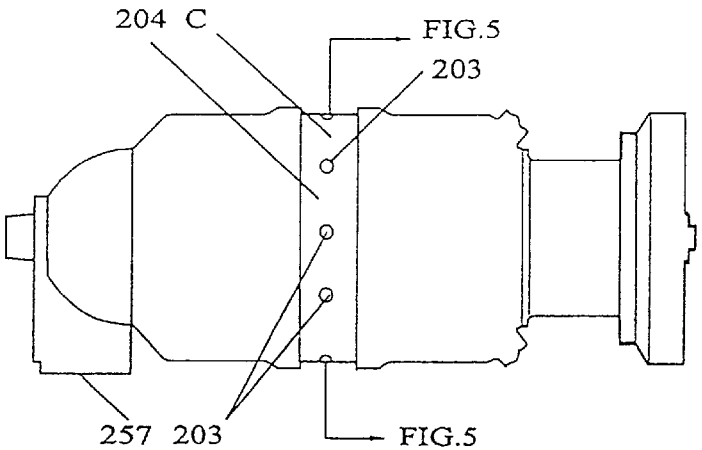
FIG. 4 illustrates a side elevation view of the engine with tubular spacer lubrication ports.

Referring further to FIGS. 4 and 5, in addition to the oil being thrown outward from the pressure fed main bearings (200) an additional means of spraying oil from outside through the tubular spacer (C) may be implemented. This provides additional oil in the area of the pistons (F), cam followers (64, 66) and the cam (E) which are the heart and most stressed portions of the engine. This additional lubricant system lubricates and cools these parts.

The tubular spacer (C) is modified to have oil apertures (203) formed therein circumferentially around the wall (204) of the tubular spacer (C). A lubricant supply system (not shown) distributes oil under pressure to the oil apertures through which the oil flows to be sprayed from the wall of the tubular spacer (C) internally to the central portion of the engine.

Further referring to FIGS. 6 and 7, an additional improvement for oil flow lubrication and cooling can include a cam follower (64,66) or piston roller having a hollow longitudinal center portion (205). This reduces the chances for cam follower (64,66) overheating, which may cause deformation or fracture, by oil flow therethrough. This also produces a lighter weight cam follower (64,66).

Referring to FIG. 7*a*, a further improvement to the cam follower (64,66) and piston (F) incorporates a trunion (64*b*, 66*b*) protrusion (207) in the piston (F) grooves and bores (65,67). The protrusions (207) are formed such that the trunions (64*b*,66*b*) must be forced past them to be rotably positioned in the grooves and bores (65,67). The protrusion (207) may be formed by creating a slightly larger diameter bore for seating the cam follower as compared to the opening through which force must be applied to seat it. It has been found by experiment that a protrusion (207) requiring a force of approximately 50 to 100 pounds provides good operating conditions. This structure prevents the cam follower (64,66) from becoming a loose part in the engine in the event of a piston (F) failure. If the cam follower (64,66) is freed, it can damage other engine components such as the engine block (B), tubular spacer (C) or cam (E).

Referring to FIGS. 8 through 10, in conjunction with employing a separate detachable valve crown assembly (210), into which hydraulic roller valve lifters (211) are inserted, an oil supply system (not shown) may be integrated to provide lubricant flow directly to the valve crown assembly (210). This structure provides oil directly to the roller valve lifters (211) hydraulic assembly (217) which are of the hydraulic lifter type as compared to currently used mechanical roller valve lifters (218). This structure reduces or eliminates the need for adjustment as required for mechanical roller valve lifters (218).

The hydraulic roller valve lifters (211) have hydraulic oil apertures (212) for introduction of oil into the lifter reservoir (213) which controls the position of hydraulic piston (214) thereby adjusting the roller valve lifters (211) for constant positioning and contact of the roller bearing (216) with the cam discs (52). The valve crown assembly (210) is in fluid communication with an oil return system (215).

Referring to FIGS. 1 and 11 through 13, a system to introduce coolant directly to the head assembly (220) and the engine block (225) simultaneously without passing through the head gasket rather than first to the head assembly (220), then through the head gasket (221) and then to the engine block (225) is introduced for improved cooling and better reliability. In current methods that supply coolant through the head gasket (221) to the engine block (225) there is frequently leaking of coolant into the cylinders (28) which causes engine damage and loss of coolant. Most axial cam drive engines disclosed in patents and the literature do not specify a coolant system structure and it is not clear how such engines could be constructed. The two channel coolant flow into and out of each element may be implemented with separate fittings and lines or use of a dual feed fitting (223) may be incorporated.

Figure 14:
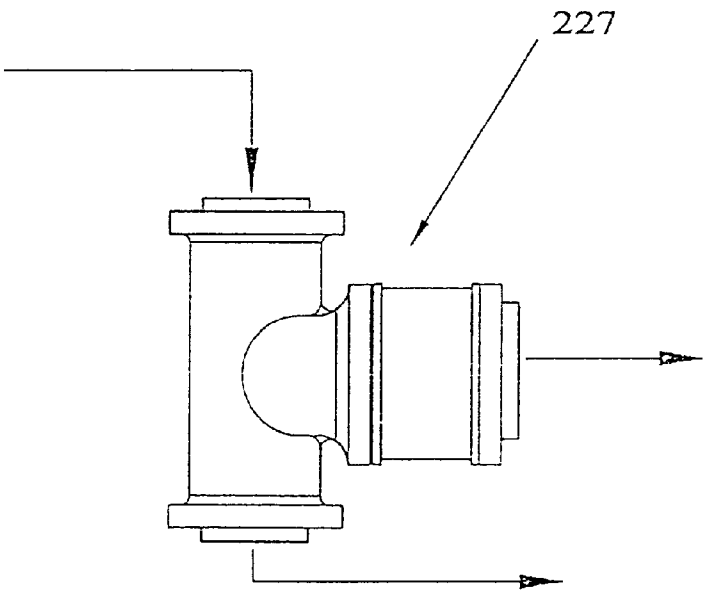
FIG. 14 illustrates a side view of a three port bypass thermostat.
Figure 13:
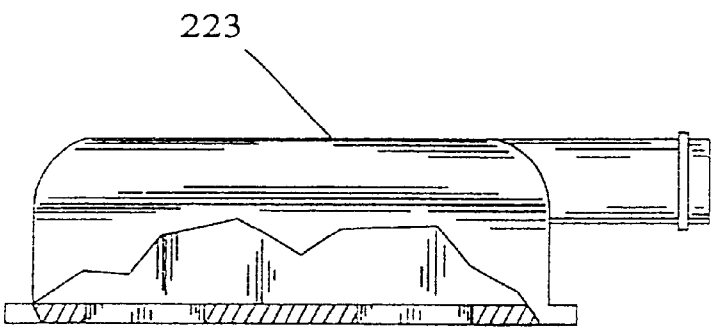
FIG. 13 illustrates a dual feed fitting for a cooling system.

Referring to FIG. 14, a three port bypass thermostat (227) is used with the engine (A) to control coolant flow. In traditional engines the thermostat is closed during engine warm up to prevent coolant flow to a radiator (not shown). When the engine coolant has reached a specific temperature the thermostat opens to allow coolant flow to the radiator for cooling thereof. In this configuration the coolant in the engine is not circulated by the water pump (not shown). The coolant therefore tends to develop localized elevated temperature locations as for example at the thermostat. The thermostat then opens prematurely, allows water circulation and then closes. This thermostat cycling may occur a number of times before proper coolant temperature is achieved. Other engine problems such as pitting of conduits and calcium depositing may occur due to coolant elevated temperature areas.

With the use of a three port bypass thermostat (227) the water pump is used from engine start up to circulate coolant through the engine. This provides a more uniform coolant temperature rise throughout the system. As the coolant is raised in temperature the thermostat (227) will close the port allowing direct flow back to the engine and open the port allowing coolant flow through the radiator and the engine. In this cooling system the water pump is located in the channel between the inlet of the engine and the flow from the radiator.

Referring to FIGS. 15 through 17A, an 8 cylinder, 4 piston, 2 stroke engine (A) has pistons (F) separated by 90 degrees circumferentially and the cam (E) lobes also have a 90 degree separation. In this configuration each cylinder (28) is on compression mode when the piston (F) is at Top Dead Center of a cycle and four of eight cylinders (28) ignite simultaneously. This engine configuration can operate either as a compression cycle engine or a spark ignition cycle engine.

Use of this configuration eliminates the need for a valve train system. The cylinders (28) are scavenged by ports (230) which allow exhaust gas flow as well as fuel, air inlet flow wherein the ports (230) opening and closing is controlled by the piston (F) position relative to the ports (230). The ports (230) are positioned in the cylinder (28) wall to control timing of the opening and closing of inlet ports (231) and exhaust parts (232). Using this system can reduce engine (A) parts needed by as much as 50 percent thereby making the engine less costly and more reliable.

Figure 17:
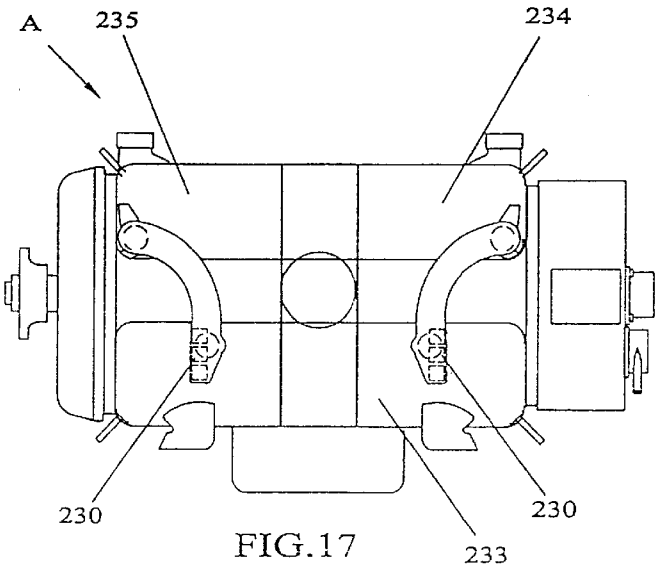
FIG. 17 illustrates a side elevation view of the engine with external cylinder conduits and fuel injectors.

The engine ducting for scavenging can be accomplished by alternate cylinders in an engine block (B) being utilized as firing cylinders (233) and compression cylinders (234). As best seen in FIG. 17, a conduit (235) from the compression cylinder (234) to the firing cylinder (233) for ducting air fuel to the firing cylinder (233).

Figure 17A:
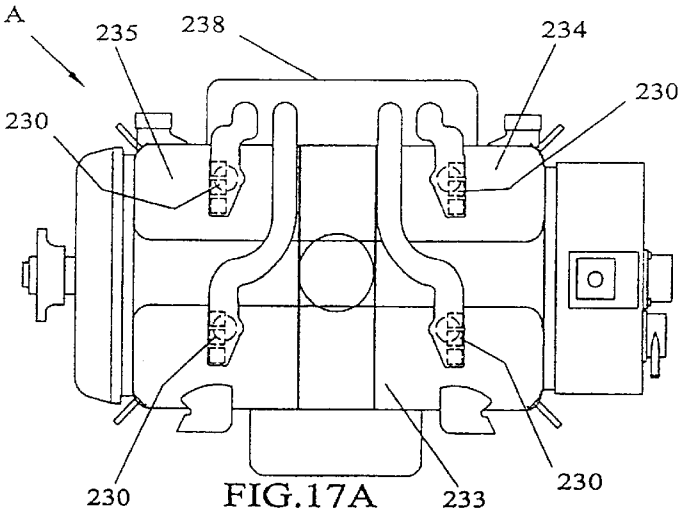
FIG. 17A illustrates a side elevation view of the engine with external ducting and a supercharger for the supply of fuel, air to the cylinders.
Figure 15:
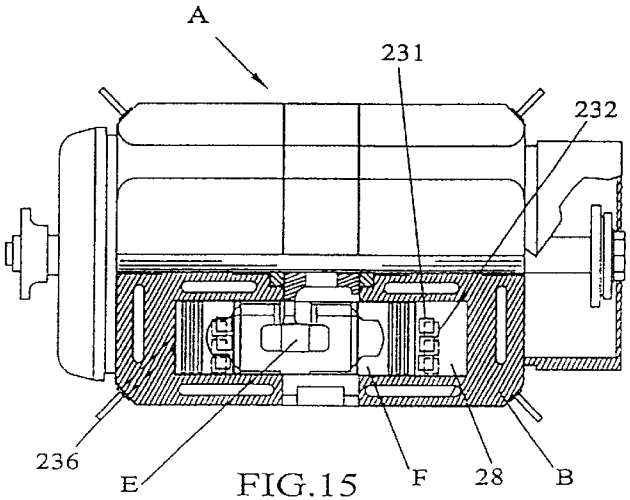
FIG. 15 illustrates a side elevation partial cross section view of the engine with intake and exhaust ports in the cylinder side wall.
Figure 16:
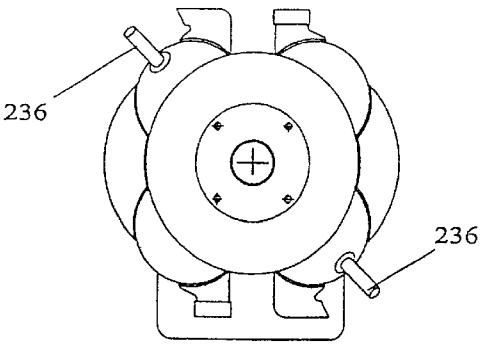
FIG. 16 illustrates an end view of the engine with intake and exhaust ports.
Figure 21:
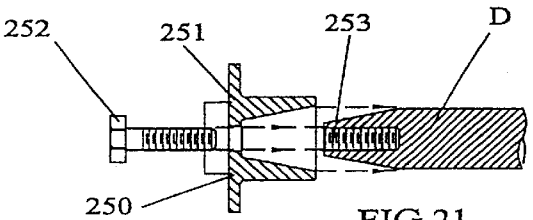
FIG. 21 illustrates a longitudinal cross section view of the hub and drive shaft.

An alternate version of the use of ports (230) wherein all cylinders (28) are firing cylinders is illustrated in FIG. 17A. In this configuration a supercharger or turbocharger (238) is used to supply air under pressure to allow scavenging. An electric motor for turning the turbocharger (not shown) may be used to create initial pressure at engine start up.

Figure 18:
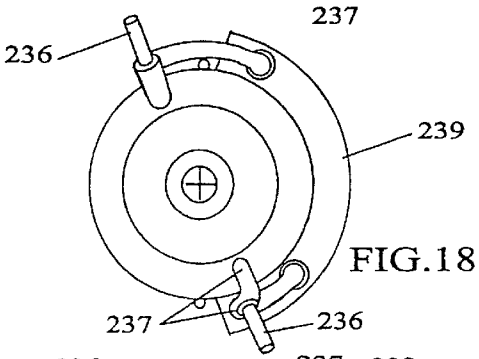
FIG. 18 illustrates an end view of the engine with fuel injectors.
Figure 19:
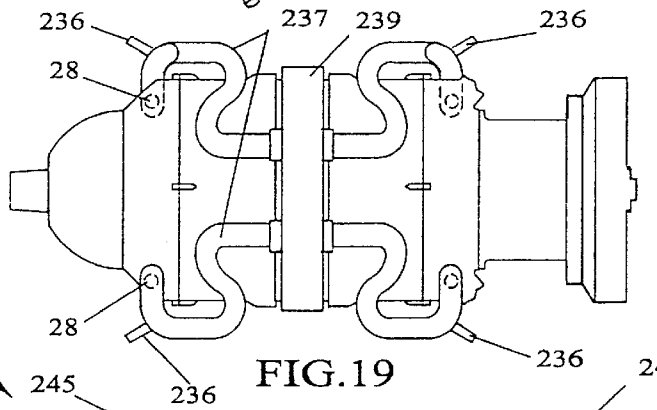
FIG. 19 illustrates a side elevation view of the engine with ducting for use of four fuel injectors to supply fuel to a 12 cylinder engine.

Referring to FIGS. 18 and 19, a fuel injection system using ducting (237) to route the input from a fuel injector (236) to three cylinders (28) is illustrated. This allows the achievement of proper fuel injection into a 12-cylinder engine using only 4 fuel injectors (236) and an intake plenum (239) thereby reducing the number of parts and improving reliability.

Figure 23:
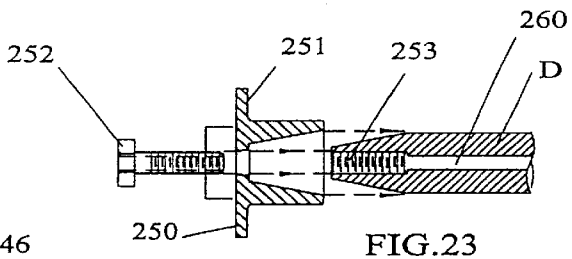
FIG. 23 illustrates a longitudinal cross section view of the hub and drive shaft with hollow center.
Figure 24:
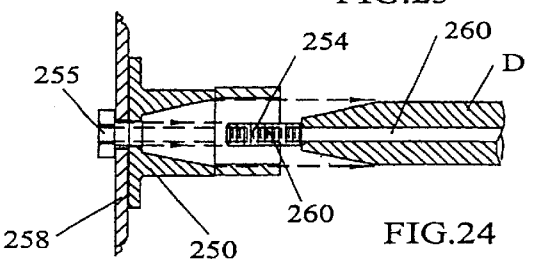
FIG. 24 illustrates a longitudinal cross section view of the hub and drive shaft with hollow center and with flywheel attached.
Figure 20:
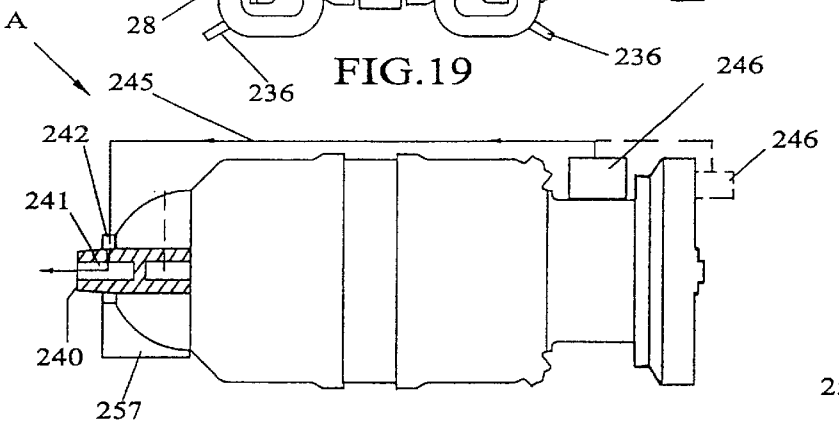
FIG. 20 illustrates a side elevation view of the engine with a hydraulic constant speed propeller system modification.

Referring to FIGS. 20, 23 and 24, an engine (A) configuration to accommodate hydraulic constant speed propeller aircraft applications is illustrated. The drive shaft (D) is modified to have a front end (240) bore (241) which is in fluid communication with a hydraulic fluid fitting (242). In addition, the bolt (252) or threaded shaft (254) have a longitudinal hollow center portion (260). Hydraulic fluid is supplied to the fitting (242) through conduit (245) which is connected to a hydraulic fluid governor pump (246) driven by the engine. The pump (246) may serve the purpose of oil supply to the engine at for example 20 to 80 psi and to the propeller at 200 to 400 psi while keeping the two systems isolated one from the other. An alternate location for the governor pump (246) is shown in dash line form.

Referring to FIGS. 1, 8, 21 and 24, modifications to the drive shaft (D) and nose (78) provide for alternate propeller mounting structure as well as a flywheel (258) and starter motor (98) implementation.

The drive shaft (D) has been modified for mounting and retention of a hub (250) having flange (251). The hub (250) may either be retained by a bolt (252) threaded into a threaded bore (253) or by an extended threaded shaft (254) having a threaded nut (255) attached. Using this system allows the drive shaft (D) to be inserted through the engine (A) without the need for having the engine block (B) and cylinder head portion thereof split in half. Once the hub (250) is attached the flange (251) provides a mounting structure for modern aircraft propellers, engine transmissions, or other devices to be easily attached for powering by the engine (A).

Figure 22:
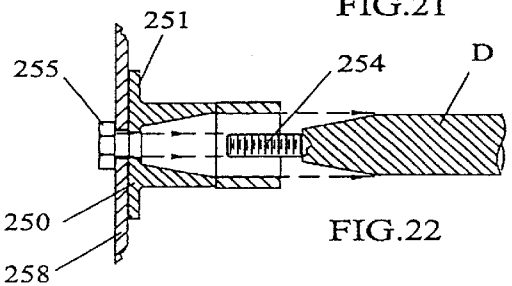
FIG. 22 illustrates a longitudinal cross section view of the hub with flywheel attached.

Referring to FIGS. 8 and 22, the adaptation of the hub (250) is illustrated to provide for attachment of a fly wheel (258). The nose (78) is modified to include a starter mount (257) to support a starter motor (98). Use of this configuration provides for moving the starter motor (98) from the housing (96) to the nose (78) end. This also allows for a larger gear, the fly wheel (258), to be used to start the engine (A). This in turn accommodates a smaller starter motor (98) requiring less torque due to the increase gear ratio between starter motor (98) and fly wheel (258). These conditions create easier starting conditions and improved engine life.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. An internal combustion engine of a cam drive axial piston type having an improved drive shaft extended equipment mounting structure, the improvement comprising:

a drive shaft insertable into and removable from a cam drive axial piston engine without the necessity to separate the engine block;

a drive shaft end portion having a taper portion to receive a hub for attachment thereto; and the hub having a flange for attachability of one of an aircraft propeller and an engine drive linkage.

2. The engine as in claim 1 wherein the hub has a flywheel attached thereto which flywheel having circumferentially a plurality of gear teeth for mating with a starter motor gear drive mechanism and the starter motor attached to the none of the engine.

* * * * *